US006979141B2

(12) United States Patent
Karst et al.

(10) Patent No.: US 6,979,141 B2
(45) Date of Patent: Dec. 27, 2005

(54) IDENTIFICATION CARDS, PROTECTIVE COATINGS, FILMS, AND METHODS FOR FORMING THE SAME

(75) Inventors: Karl A. Karst, Woodbury, MN (US); Gary M. Klinefelter, Eden Prairie, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 10/865,521

(22) Filed: Jun. 10, 2004

(65) Prior Publication Data

US 2004/0224103 A1 Nov. 11, 2004

Related U.S. Application Data

(63) Continuation-in-part of application No. 10/717,800, filed on Nov. 20, 2003, which is a continuation-in-part of application No. 09/799,196, filed on Mar. 5, 2001, now abandoned.

(60) Provisional application No. 60/478,490, filed on Jun. 13, 2003, provisional application No. 60/493,129, filed on Aug. 7, 2003.

(51) Int. Cl.[7] ..... B42D 15/10; B41J 2/325

(52) U.S. Cl. ..... 400/679; 156/60; 156/182; 156/235; 156/240; 156/249; 156/277; 428/40.1; 428/41.7; 428/41.8

(58) Field of Search ..... 428/40.1, 41.7, 428/41.8; 156/60, 182, 230, 235, 240, 241, 156/247, 249, 277

(56) References Cited

U.S. PATENT DOCUMENTS

| | | | | |
|---|---|---|---|---|
| 3,434,902 | A | 3/1969 | Bliss | 156/230 |
| 3,713,939 | A | 1/1973 | Preg | 156/248 |
| 3,857,527 | A | 12/1974 | Kranz | 242/75.5 |
| 3,879,246 | A | 4/1975 | Walker | 156/265 |
| 3,922,435 | A | 11/1975 | Asnes | 428/349 |
| 4,006,050 | A | 2/1977 | Hurst et al. | 101/369 |
| 4,032,135 | A | 6/1977 | Ruenzi | 271/116 |
| 4,224,358 | A | 9/1980 | Hare | 427/147 |
| 4,235,657 | A | 11/1980 | Greenman et al. | 156/234 |
| 4,300,974 | A | 11/1981 | Bauer | 156/360 |
| 4,399,209 | A | 8/1983 | Sanders et al. | 430/138 |
| 4,474,850 | A | 10/1984 | Burwasser | 428/336 |
| 4,528,242 | A | 7/1985 | Burwasser | 428/413 |
| 4,548,857 | A | 10/1985 | Galante | 428/200 |

(Continued)

FOREIGN PATENT DOCUMENTS

EP 0 442 762 8/1991

(Continued)

OTHER PUBLICATIONS

Machine translation of JP 11034545 to Shindou et al. from Japanese Patent Office website.*

(Continued)

*Primary Examiner*—Daniel J. Colilla
(74) *Attorney, Agent, or Firm*—Westman, Champlin & Kelly, P.A.

(57) ABSTRACT

The present invention relates to a protective film for application to a card member and forming identification cards having protective films. The method of applying protection to a card member includes providing a protective film. The protective film includes a protective overlay and an ink-receptive material. The ink-receptive material includes an ink-receptive coating on a backing layer. The ink-receptive coating is bonded to the protective overlay. The method also includes removing the backing layer from the ink-receptive coating and laminating the ink-receptive coating to a surface of a card member.

39 Claims, 9 Drawing Sheets

U.S. PATENT DOCUMENTS

| | | | | |
|---|---|---|---|---|
| 4,555,437 | A | 11/1985 | Tanck | 428/212 |
| 4,568,403 | A | 2/1986 | Egan | 156/247 |
| 4,575,465 | A | 3/1986 | Viola | 427/261 |
| 4,578,285 | A | 3/1986 | Viola | 427/209 |
| 4,592,954 | A | 6/1986 | Malhotra | 428/335 |
| 4,617,080 | A | 10/1986 | Kobayashi et al. | 156/359 |
| 4,650,714 | A | 3/1987 | Kojima et al. | 428/341 |
| 4,680,235 | A | 7/1987 | Murakami et al. | 428/414.4 |
| 4,732,786 | A | 3/1988 | Patterson et al. | 427/261 |
| 4,758,461 | A | 7/1988 | Akiya et al. | 428/212 |
| 4,758,952 | A | 7/1988 | Harris, Jr. et al. | 364/300 |
| 4,770,934 | A | 9/1988 | Yamasaki et al. | 428/331 |
| 4,830,911 | A | 5/1989 | Kojima et al. | 428/342 |
| 4,839,200 | A | 6/1989 | Hoffman et al. | 427/265 |
| 4,868,581 | A | 9/1989 | Mauri et al. | 346/1.1 |
| 4,877,678 | A | 10/1989 | Hasegawa et al. | 428/216 |
| 4,877,686 | A | 10/1989 | Riou et al. | 428/514 |
| 4,877,688 | A | 10/1989 | Senoo et al. | 428/522 |
| 4,897,533 | A | 1/1990 | Lyszczarz | 235/487 |
| 4,900,620 | A | 2/1990 | Tokita et al. | 428/330 |
| 4,910,084 | A | 3/1990 | Yamasaki et al. | 428/411.1 |
| 4,926,190 | A | 5/1990 | Laver | 346/1.1 |
| 4,944,988 | A | 7/1990 | Yasuda et al. | 428/195 |
| 4,966,815 | A | 10/1990 | Hare | 428/497 |
| 4,980,224 | A | 12/1990 | Hare | 428/202 |
| 5,006,407 | A | 4/1991 | Malhotra | 428/336 |
| 5,019,475 | A | 5/1991 | Higashiyama et al. | 430/138 |
| 5,028,028 | A | 7/1991 | Yamada et al. | 248/430 |
| 5,041,328 | A | 8/1991 | Akiya et al. | 428/212 |
| 5,073,448 | A | 12/1991 | Vieira et al. | 428/331 |
| 5,084,340 | A | 1/1992 | Light | 428/327 |
| 5,096,781 | A | 3/1992 | Vieira et al. | 428/411.1 |
| 5,101,218 | A | 3/1992 | Sakaki et al. | 346/1.1 |
| 5,110,389 | A | 5/1992 | Hiyoshi et al. | 156/234 |
| 5,118,570 | A | 6/1992 | Malhotra | 428/474.4 |
| 5,120,601 | A | 6/1992 | Kotaki et al. | 428/327 |
| 5,124,201 | A | 6/1992 | Kurabayashi et al. | 428/323 |
| 5,126,193 | A | 6/1992 | Light | 428/327 |
| 5,126,194 | A | 6/1992 | Light | 428/327 |
| 5,137,778 | A | 8/1992 | Nakatsugawa et al. | 428/330 |
| 5,139,867 | A | 8/1992 | Light | 428/327 |
| 5,139,868 | A | 8/1992 | Mori et al. | 428/327 |
| 5,139,917 | A | 8/1992 | Hare | 430/138 |
| 5,141,797 | A | 8/1992 | Wheeler | 428/195 |
| 5,165,973 | A | 11/1992 | Kojima et al. | 428/331 |
| 5,171,626 | A | 12/1992 | Nagamine et al. | 428/212 |
| 5,180,624 | A | 1/1993 | Kojima et al. | 428/211 |
| 5,185,213 | A | 2/1993 | Fujita et al. | 428/500 |
| 5,190,234 | A | 3/1993 | Ezekiel | 156/502 |
| 5,190,805 | A | 3/1993 | Atherton et al. | 428/195 |
| 5,194,317 | A | 3/1993 | Sato et al. | 428/195 |
| 5,206,071 | A | 4/1993 | Atherton et al. | 428/195 |
| 5,208,092 | A | 5/1993 | Iqbal | 428/195 |
| 5,213,873 | A | 5/1993 | Yasuda et al. | 428/195 |
| 5,236,801 | A | 8/1993 | Hare | 430/199 |
| 5,238,524 | A | 8/1993 | Seki et al. | 156/538 |
| 5,241,328 | A | 8/1993 | Sarraf et al. | 347/232 |
| 5,246,774 | A | 9/1993 | Sakaki et al. | 428/323 |
| 5,252,531 | A | 10/1993 | Yasuda et al. | 503/227 |
| 5,266,383 | A | 11/1993 | Sakaki et al. | 428/195 |
| 5,271,990 | A | 12/1993 | Kronzer et al. | 428/195 |
| 5,277,501 | A | 1/1994 | Tanaka et al. | 400/120 |
| 5,277,734 | A | 1/1994 | Bayer | 156/230 |
| 5,277,962 | A | 1/1994 | Nakatsugawa et al. | 428/206 |
| 5,281,467 | A | 1/1994 | Shimada et al. | 428/195 |
| 5,302,436 | A | 4/1994 | Miller | 428/195 |
| 5,302,437 | A | 4/1994 | Idei et al. | 428/195 |
| 5,320,897 | A | 6/1994 | Kondo et al. | 428/195 |
| 5,328,748 | A | 7/1994 | Westfal | 428/195 |
| 5,334,439 | A | 8/1994 | Kawaguchi et al. | 428/212 |
| 5,338,597 | A | 8/1994 | Kurabayashi et al. | 428/195 |
| 5,352,503 | A | 10/1994 | Drake et al. | 428/195 |
| 5,362,558 | A | 11/1994 | Sakaki et al. | 428/323 |
| 5,362,703 | A | 11/1994 | Kawasaki et al. | 503/227 |
| 5,364,702 | A | 11/1994 | Idei et al. | 428/423.1 |
| 5,372,884 | A | 12/1994 | Abe et al. | 428/331 |
| 5,407,724 | A | 4/1995 | Mimura et al. | 428/141 |
| 5,431,501 | A | 7/1995 | Hale et al. | 400/120.02 |
| 5,437,960 | A | 8/1995 | Nagate et al. | 430/256 |
| 5,447,566 | A | 9/1995 | Loiacond | 101/228 |
| 5,484,215 | A | 1/1996 | Fillod et al. | 400/120.18 |
| 5,484,502 | A | 1/1996 | Bozanic | 156/235 |
| 5,503,702 | A | 4/1996 | Filicicchia et al. | 156/249 |
| 5,532,724 | A | 7/1996 | Inagaki et al. | 347/213 |
| 5,549,774 | A | 8/1996 | Miekka et al. | 156/209 |
| 5,614,058 | A | 3/1997 | Didelot et al. | 156/542 |
| 5,623,001 | A | 4/1997 | Figer | 106/31.43 |
| 5,626,699 | A | 5/1997 | Didelot et al. | 156/99 |
| 5,647,938 | A | 7/1997 | Levine | 156/269 |
| 5,697,297 | A | 12/1997 | Rasmussen | 101/211 |
| 5,700,537 | A | 12/1997 | Instance | 156/253 |
| 5,706,042 | A | 1/1998 | Takeyama et al. | 347/100 |
| 5,707,925 | A | 1/1998 | Akada et al. | 503/227 |
| 5,729,817 | A | 3/1998 | Raymond et al. | 400/635 |
| 5,735,994 | A | 4/1998 | Lappe et al. | 156/386 |
| 5,765,481 | A | 6/1998 | Tortora et al. | 101/211 |
| 5,769,408 | A | 6/1998 | Selak et al. | 271/10.03 |
| 5,770,268 | A | 6/1998 | Kuo et al. | 427/386 |
| 5,773,188 | A | 6/1998 | Ellis | 430/201 |
| 5,790,924 | A | 8/1998 | Creutzmann et al. | 399/110 |
| 5,798,161 | A | 8/1998 | Kita et al. | 428/64.1 |
| 5,807,461 | A | 9/1998 | Hagstrom | 156/361 |
| 5,814,796 | A | 9/1998 | Benson et al. | 235/375 |
| 5,820,277 | A | 10/1998 | Schulte | 400/223 |
| 5,825,392 | A | 10/1998 | Mochizuki | 347/197 |
| 5,850,248 | A | 12/1998 | Bellemore | 347/262 |
| 5,861,355 | A | 1/1999 | Olson et al. | 503/201 |
| 5,941,522 | A | 8/1999 | Hagstrom et al. | 271/225 |
| 5,942,335 | A | 8/1999 | Chen et al. | 428/500 |
| 5,980,011 | A | 11/1999 | Cummins et al. | 347/4 |
| 5,981,045 | A | 11/1999 | Kuwabara et al. | 428/212 |
| 5,981,077 | A | 11/1999 | Taniguchi | 428/447 |
| 6,001,209 | A | 12/1999 | Popat et al. | 156/249 |
| 6,001,771 | A * | 12/1999 | Nakano et al. | 503/227 |
| 6,017,031 | A | 1/2000 | Oosawa et al. | 271/121 |
| 6,051,306 | A | 4/2000 | Paulson | 428/195 |
| 6,054,223 | A | 4/2000 | Tsuchiya et al. | 428/478.2 |
| 6,066,387 | A | 5/2000 | Ueda et al. | 428/212 |
| 6,071,368 | A | 6/2000 | Boyd et al. | 156/240 |
| 6,096,396 | A * | 8/2000 | Patton et al. | 428/40.1 |
| 6,103,042 | A | 8/2000 | Hatada et al. | 156/235 |
| 6,108,020 | A | 8/2000 | Oshima | 347/214 |
| 6,152,038 | A | 11/2000 | Wagner et al. | 101/488 |
| 6,174,404 | B1 | 1/2001 | Klinger | 156/272.2 |
| 6,241,332 | B1 | 6/2001 | Cummins et al. | 347/4 |
| 6,245,479 | B1 | 6/2001 | Etzel | 428/195 |
| 6,261,012 | B1 | 7/2001 | Haas et al. | 156/265 |
| 6,270,858 | B1 | 8/2001 | Paulson | 427/508 |
| 6,299,967 | B1 * | 10/2001 | Collins et al. | 428/32.12 |
| 6,368,684 | B1 * | 4/2002 | Onishi et al. | 428/32.6 |
| 6,497,781 | B1 | 12/2002 | Dalvey et al. | 156/234 |
| 6,565,204 | B2 | 5/2003 | Matsuhashi et al. | 347/103 |
| 6,640,717 | B2 | 11/2003 | Kosaka et al. | 101/487 |
| 6,644,802 | B2 | 11/2003 | Minowa | 347/105 |
| 6,646,666 | B2 | 11/2003 | Matsuoka | 347/213 |
| 2002/0012773 | A1 | 1/2002 | Vaidya et al. | 428/195 |
| 2002/0018253 | A1 * | 2/2002 | Toshine et al. | 359/3 |
| 2002/0048654 | A1 | 4/2002 | Yoshino et al. | 428/195 |
| 2003/0059565 | A1 * | 3/2003 | Otaki et al. | 428/40.1 |
| 2003/0213550 | A1 * | 11/2003 | Daems et al. | 156/250 |
| 2004/0135241 | A1 | 7/2004 | Conner et al. | 257/679 |
| 2004/0146329 | A1 | 7/2004 | Klinefelter | 400/120.01 |
| 2004/0161555 | A1 * | 8/2004 | Niu et al. | 428/32.1 |

FOREIGN PATENT DOCUMENTS

| | | | | | |
|---|---|---|---|---|---|
| EP | 1 013 466 | A2 | | 6/2000 | |
| JP | 3-234670 | | | 10/1991 | |
| JP | 07314882 | A | | 12/1995 | |
| JP | 8-66999 | | | 3/1996 | |
| JP | 09300675 | A | | 11/1997 | ..... 02/325 |
| JP | 11034545 | A | * | 2/1999 | ..... B42D 15/10 |
| JP | 11 219116 | A | | 10/1999 | |
| JP | 2002307874 | A | | 10/2002 | ..... 15/10 |
| WO | WO 98/16394 | | | 4/1998 | |
| WO | WO 98/24632 | | | 6/1998 | |
| WO | WO 99/04080 | | | 1/1999 | |

OTHER PUBLICATIONS

U.S. Appl. No. 60/478,490, filed Jun. 13, 2003.
U.S. Appl. No. 60/493,129, filed Aug. 7, 2003.
U.S. Appl. No. 10/717,800, filed Nov. 20, 2003.
Office Communication with Office Action Summary for U.S. Appl. No. 10/757,823, filed Jan. 15, 2004 with a mailing date of Sep. 7, 2004.
Office Action dated Nov. 5, 2003 for U.S. Appl. No. 09/799,196.
U.S. Appl. No. 09/799,196, filed Mar. 5, 2001 entitled "Printer with Reverse Image Sheet".
Office Communication with Office Action Summary for Application No. 10/717,800, filed Feb. 1, 2005 with a mailing date of Feb. 1, 2005.
Machine translation of 09300675 to Ando et al. from Japanese Patent Office website.
Machine translation of 2002307874 to Hashiba et al. from Japanese Patent Office website.

* cited by examiner

IDENTIFICATION CARDS, PROTECTIVE COATINGS, FILMS, AND METHODS FOR FORMING THE SAME

CROSS-REFERENCE TO RELATED APPLICATIONS

The present application claims the benefit of U.S. provisional patent applications Ser. Nos. 60/478,490, filed Jun. 13, 2003 and U.S. provisional patent application Ser. No. 60/493,129, filed Aug. 7, 2003; and is a continuation-in-part of U.S. patent application entitled "INK-RECEPTIVE CARD SUBSTRATE," Ser. No. 10/717,800, filed Nov. 20, 2003 which is a continuation-in-part of U.S. patent application entitled "PRINTER WITH REVERSE IMAGE SHEET," Ser. No. 09/799,196, filed Mar. 5, 2001, the contents of which are hereby incorporated by reference in their entirety.

BACKGROUND OF THE INVENTION

Ink jet printers are known and provide a number of advantages in the printing process. For example, ink jet printers are capable of providing relatively high-density color output at an acceptable printing speed. Furthermore, such printers are relatively inexpensive. As a result, it is desirable to utilize such printers in the formation of identification cards.

Identification card substrates generally have polyvinyl chloride (PVC) or polyvinyl chloride/polyvinyl acetate (PVC/PVCAc) surfaces. These surfaces can be printed using a Dye Diffusion Thermal Transfer (DDTT) technology where dyes and/or resins are deposited at or near the surfaces of the card substrates. Images printed on the surfaces of these card substrates are susceptible to defacement due to abrasion, exposure, water and other environmental conditions. Accordingly, a protective material should be applied over the printed card surface to protect the printed image.

To provide protection to the printed image on the card substrate surface, overlays can be applied to the printed card surface. Thin film overlays can be used to provide edge-to-edge protection to a printed surface. Unfortunately, such thin overlays only provide limited protection to the printed card surface.

In the alternative, patch laminates can be applied to printed card surfaces to provide additional protection to DDTT images. Patches generally made of a polyester (PET) film and a thermal adhesive provide a bond between the polyester film and the card surface. Although patch laminates exhibit resilient protection for a printed card surface, patch laminates do not generally provide edge-to-edge protection to the printed card surface since they are formed slightly smaller than the card. Additionally, after lamination of a patch, card substrates can become warped along the outer edges of the identification card.

Ink-receptive films have been applied to card substrates to form an ink-receptive surface thereon. FIG. 1 illustrates an ink-receptive film 10 formed of a clear or an opaque backing layer (e.g. PET, PVC, etc.) 12, on which an ink-receptive coating 14 is applied in accordance with the prior art. A layer of adhesive 16 is generally applied between the backing layer 12 and a surface 18 of a rigid or semi-rigid card member 20. Card member 20 is a conventional blank card substrate that is typically formed of PVC or suitable material. Ink receptive film 10 is laminated to card member 20 through application of heat and pressure. Portions of ink-receptive film 10 that overhang the edges of card member 20 are then trimmed as necessary. A laminate layer 22 can be laminated to a bottom surface 24 of card member 20 by adhesive layer 26 in an effort to counterbalance stresses that are applied to card member 20 as a result of the lamination of backing layer 12 of ink-receptive film 10 to surface 18 of card member 20.

Unfortunately, the above-described process of forming an ink-receptive card substrate using an ink-receptive film is problematic. The layers of adhesive, ink-receptive film, card member, and the laminate, result in a complex and expensive ink-receptive card substrate. Also, the backing layer of the ink-receptive film can potentially delaminate from the card member due to its exposed edges, thereby limiting the useful life span of the ink-receptive card substrate. Additionally, the image that is printed to the ink-receptive surface that is formed by the ink-receptive coating of the film can be defaced due to abrasion, exposure, water and other environmental conditions. As a result, images that are printed to ink-receptive surfaces of card substrates or printed directly to card surfaces should be protected by a protective material that provides both edge-to-edge protection as well as resiliency.

SUMMARY OF THE INVENTION

The present invention relates to a protective film for application to a card member and a method of applying a protective film to a card member. The protective film includes a protective overlay and an ink-receptive material. The ink-receptive material includes an ink-receptive coating on a backing layer. The ink-receptive coating is bonded to the protective overlay. The method also includes removing the backing layer from the ink-receptive coating and laminating the ink-receptive coating to a surface of a card member.

Additional embodiments of the present invention are directed to card substrates and identification cards that can be formed in accordance with the above-described method.

DETAILED DESCRIPTION OF THE PREFERRED EMBODIMENTS

Embodiments of the present invention are directed toward a protective film for application to an identification card member or card substrate. By using an ink-receptive material as at least a portion of the protective film, the present invention can provide a durable card member having edge-to-edge protection.

Figure 2:
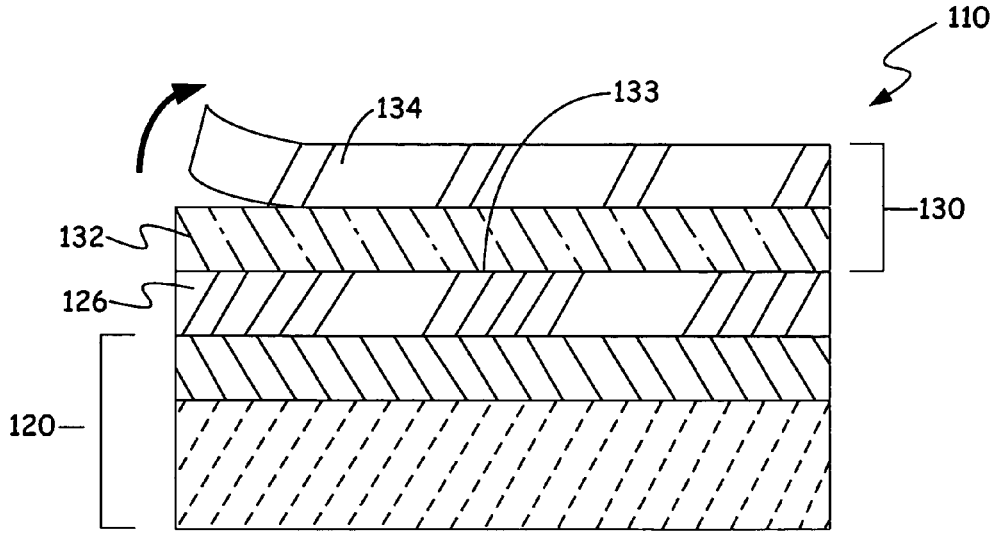
FIG. 2 is a simplified sectional view of a protective film in accordance with an embodiment of the present invention.

FIG. 2 illustrates a simplified sectional view of a protective film 110 for application onto a card member in accordance with an embodiment of the present invention. Protective film 110 includes an ink-receptive material 130 having an ink receptive coating 132 and a backing layer 134. Ink receptive material 130 is adhered to a protective overlay 120 by an adhesive 126.

Figure 3:
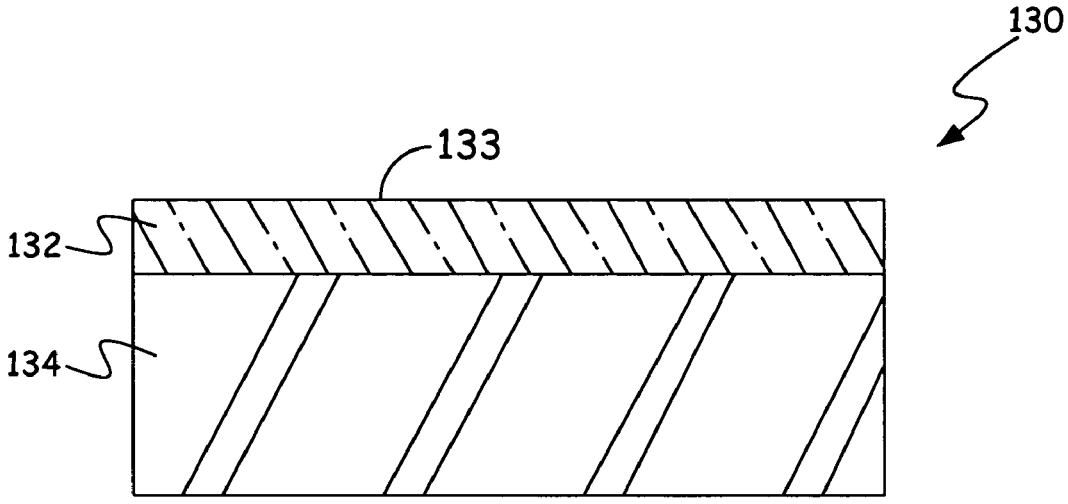
FIG. 3 is a simplified sectional view of an ink-receptive material in accordance with an embodiment of the present invention.

As illustrated in FIG. 3, to form protective film 110, an ink-receptive material 130 is provided in accordance with an embodiment of the present invention. Ink-receptive material 130 includes an ink-receptive coating 132 on a backing layer 134 (e.g., PET). Ink-receptive coating 132 has a surface 133 and a thickness of approximately 1 mil. Backing layer 134 has a thickness of approximately 4 mils.

Ink-receptive coating 132 is applied to substrate layer 134 by roll coating, air knife coating, blade coating, rod or bar coating or a variety of other methods. Coating 132 generally contains inorganic ceramic materials and organic components. The principal ceramic component of ink-receptive coating 132 can be the boehmite form of alumina hydrate ($Al_2O_3$). The principal organic component of protective layer 132 is generally a starch or polyvinyl alcohol (PVA). Coating 132 is formed using an alumina sol to which a starch or PVA has been added to at a 5–50% weight percent (typically 10%) level based on alumina hydrate solids. Ink-receptive coating 132 is applied to backing layer 134 such that the final dried layer thickness is in the range of 10–50 microns, and preferably in the range of 20–35 microns. Ink-receptive coating 132 has an average pore radius in the range of 5–20 nanometers, with pore volumes in the range of 0.3–1.0 ml/gram.

The organic portion of coating 132 acts as a binder. It should be noted that the binder can be made of many types of materials. For example, the binder can be made of a styrene-butadiene copolymer rubber (NBR) latex, carboxymethyl cellulose, hydroxymethyl cellulose or polyvinyl pyrrolidone. Coating 132 is applied to backing layer 134. For example, backing layer 134 can include polymeric films and polyester resin, such as PET, polyester diacetate polycarbonate resins, fluroresisns (i.e. ETFE) and polyvinyl chloride resins, paper sheets and synthetic paper sheets. Coating 132 can also contain other materials to provide weather resistance, provide improved light and ozone resistance, assist in the stability of dyes and prevent dye fading. For example, additional polymerizable binders can be used to improve weather resistance, additional magnesium (Mg) and/or thiocyancate (SCN) ions can provide improved light and ozone resistance, additional organic materials such as dithiocarbamates, thiurams, thiocyanate esters, thiocyanates and hindered amines help prevent dye fading and additional non-ionic or cationic water insoluble resins particles can improve coating stability.

Other coatings can be added to coating 132. For example, a silica gel coating can be applied to improve gloss and abrasion resistance and silica agglomerates can be used to promote receptivity for pigmented inks.

Suitable ink-receptive materials 130 are produced by Ikonics Corporation of Duluth, Minn., such as AccuArt™ and AccuBlack™, which are generally used for the production of film positives, negatives, color proofs and full-color presentation transparency displays. The ink-receptive coating of AccuArt™ includes many of the desired features and components for ink-receptive material 130. Although the AccuArt™ film is a suitable film for the present invention, those skilled in the art should recognize that other ink-receptive coatings can be applied to backing layer 134.

Figure 4:
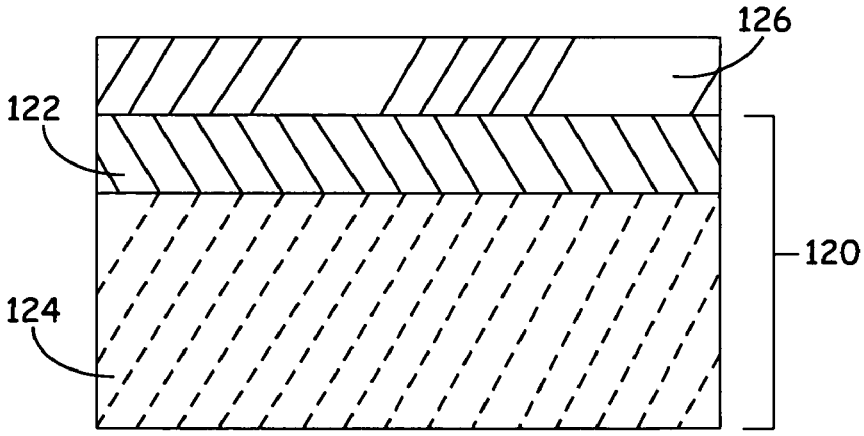
FIG. 4 is a simplified sectional view of a protective overlay and an adhesive in accordance with an embodiment of the present invention.

FIG. 4 illustrates a simplified sectional view of protective overlay 120 and adhesive 126 for lamination to ink-receptive material 130 in accordance with an embodiment of the present invention. Protective overlay 120 includes a transfer film layer 122 and a carrier layer 124. Carrier layer 124 is formed of a polyester. In accordance with one embodiment, transfer film layer 122 is formed of a material such as polymethyl methacrylate (PMMA) and can include a security mark or hologram. Adhesive layer 126 is a thermal adhesive layer and provides protective overlay 120 with a bond to ink-receptive material 130. The thickness of transfer film layer 122 and adhesive layer 126 is approximately 3–6 microns.

Figure 5:
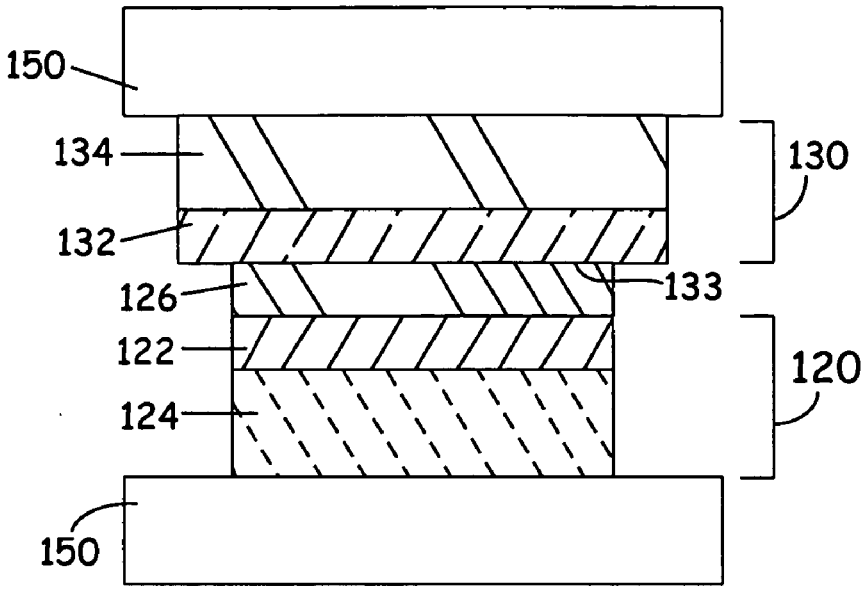
FIG. 5 illustrates a simplified sectional view of a protective film passing through a device for lamination in accordance with an embodiment of the present invention.

As shown in FIG. 5, ink-receptive material 130 is laid over adhesive layer 126 and protective overlay 120 with surface 133 of ink-receptive coating 132 facing adhesive layer 126. Although FIGS. 2, 4 and 5 illustrate adhesive 126 for bonding ink receptive coating 132 to protective overlay 120, in an alternative embodiment, ink-receptive coating 132 can be heat laminated directly to protective overlay 120 without an adhesive. In this aspect, ink-receptive material 130 is laid over protective overlay 120 with ink-receptive coating 132 facing transfer film layer 122. Even though it is possible to have ink-receptive material 130 formed smaller than protective overlay 120 and adhesive layer 126, it is desirable to have ink-receptive material 130 be slightly larger to transfer the entire ink-receptive coating 132 to protective overlay 120. Thus, it is desirable that ink-receptive material 130 overhang the edges of protective overlay 120. Ink-receptive material 130 can be in the form of an individual sheet, a web of individual sheets that are linked together, or an ink-receptive film or web that is carried by supply and take-up rolls.

Ink-receptive material 130, adhesive layer 126 and protective overlay 120 are placed in a device 150 for lamination. For example, device 150 can be hot rollers or lamination plates, both of which can have or not have a liner. Ink-receptive material 130 is laminated to protective overlay 120 under application of heat (in the range of 250–300 degrees Fahrenheit) and pressure. Sufficient pressure must be present to ensure bubble-free lamination. The lamination and adhesive layer 126 cause ink-receptive material 130 to bond directly to protective overlay 120 to form a protective film 110 (FIG. 2) having an ink-receptive surface.

Figure 1:
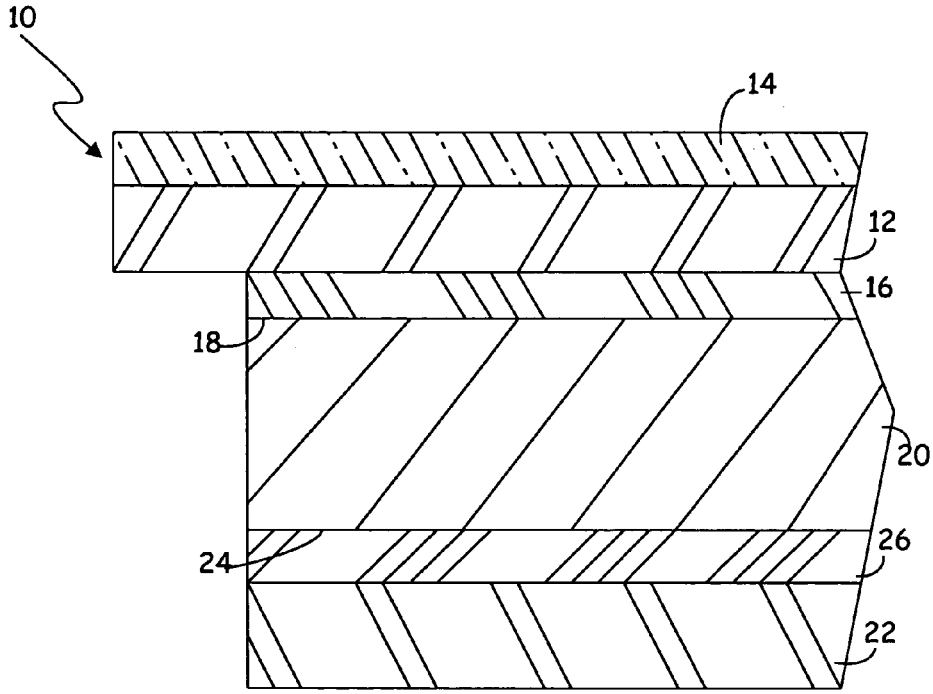
FIG. 1 (PRIOR ART)
FIG. 1 is a simplified sectional view of an ink-receptive film that is applied to a card member in accordance with methods of the prior art.
Figure 6:
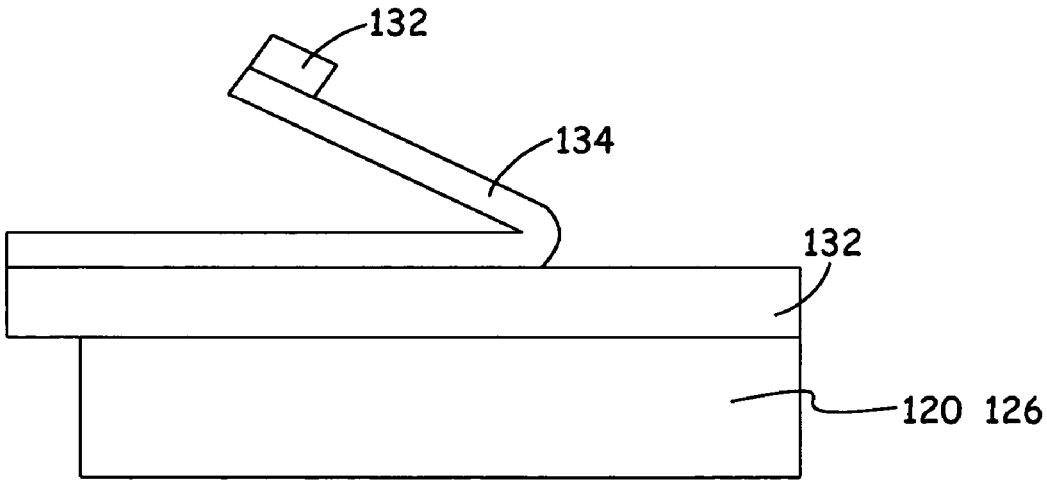
FIG. 6 illustrates removal of a backing layer from an ink-receptive coating in accordance with an embodiment of the present invention.

After ink-receptive material 130, adhesive layer 126 and protective overlay 120 exit from device 150, they are cooled to ambient temperature. As illustrated in FIG. 6, backing layer 134 is peeled away from ink-receptive coating 132. During this step, ink-receptive coating 132, previously bonded to protective overlay 120 during lamination, remains bonded to protective overlay 120 to thereby form a protective film 110 (FIG. 1). A portion of ink-receptive coating 132 that was not bonded to protective overlay 120 remains attached to backing layer 134. As a result, the method of the present invention avoids having to trim backing layer 134. In some embodiments, an adhesion promoter is used at the interface of adhesive layer 126 and ink-receptive coating 132 to assure complete transfer of ink-receptive coating 132 from backing 134.

In one embodiment, surface 133 (FIG. 3) of ink-receptive coating 132 is imaged before ink-receptive material 130 is laminated to protective overlay 120. In another embodiment, surface 133 (FIG. 2) of ink-receptive coating 132 is imaged after ink-receptive material 130 is laminated to protective overlay 120 and after backing layer 134 is peeled off. In either of the embodiments, the image is printed with a water-based ink jet system and viewed through protective overlay 120, adhesive 126 and ink-receptive coating 132. The image is allowed to dry (1–30 seconds is typically sufficient) before either ink-receptive material 130 is laminated to protective overlay 120 or protective film 110 is laminated to a card member. In another embodiment, an image can be directly printed to a surface of a card member by conventional thermal imaging techniques before protective film 110 is laminated to the card member.

Figure 7:
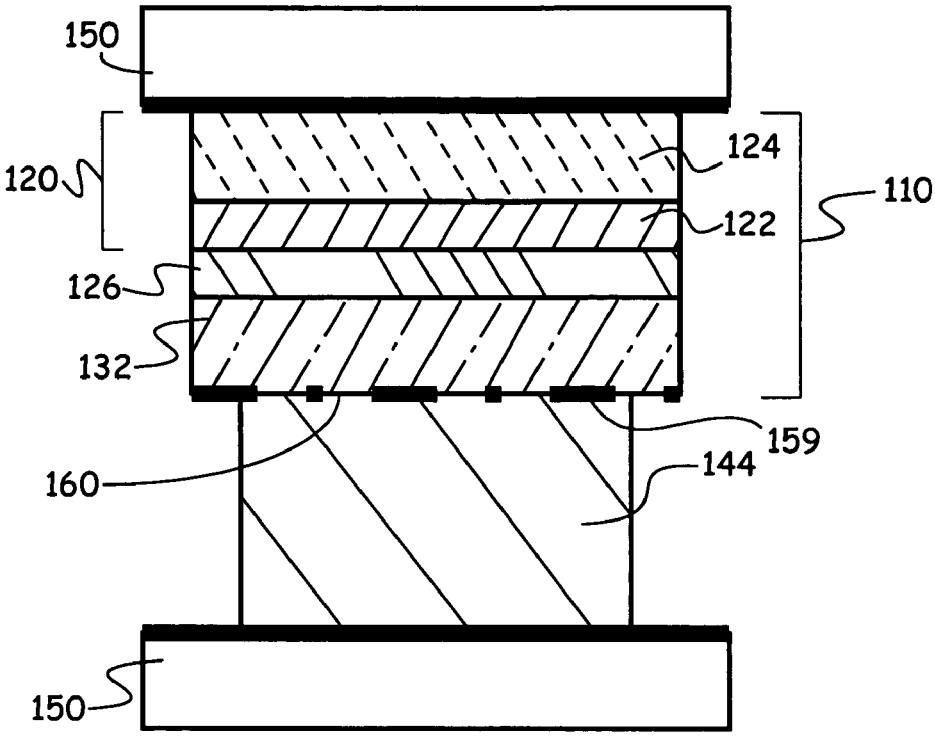
FIG. 7 illustrates a simplified sectional view of a card package passing through a device for lamination in accordance with an embodiment of the present invention.

FIG. 7 illustrates a card package 142 passing through device 150 for lamination in accordance with an embodiment of the present invention. Card package 142 includes a card member 144 for lamination to protective film 110 and an image 159. Card member 144 is preferably formed of a rigid or semi-rigid material, such as PVC, and has a surface 160. Card member 144 can be in the form of an individual card substrate (i.e., standard identification card size). Alternatively, card member 144 can be in the form of a sheet (e.g., 2 ft. by 2 ft.) of card substrate material, from which individual card substrates can be cut, to facilitate mass card substrate production. For example, the thickness of card member 144 is selected such that the final laminated card package 142 is approximately 30 mils and meets standard ISO requirements. Card package 142 also includes ink-receptive coating 132, protective overlay 120 and adhesive 126. Ink-receptive coating 132 is placed in contact with card surface 160. Card package 142 is placed inside device 150. Ink-receptive coating 132, protective overlay 120 and adhesive 126 are laminated to card member 144 under heat and pressure. It is desirable to have protective film 110 be slightly larger than the card to transfer the entire film 110 to card member 144 such that carrier layer 124 can be separated from the remaining protective film 110 as will be discussed in more detail below.

Figure 8:
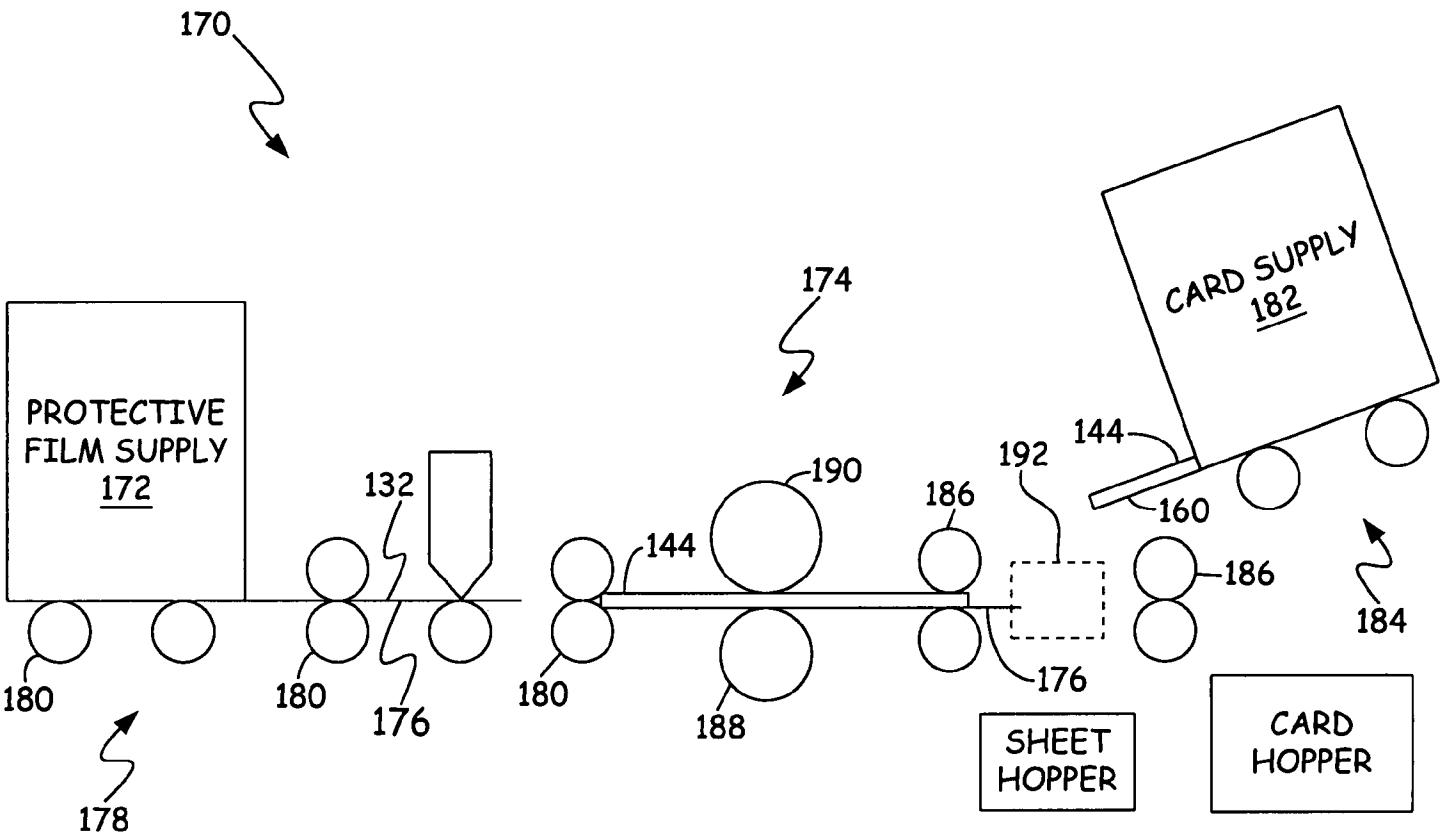
FIG. 8 is a schematic diagram of a device that is configured to form an identification card in accordance with an embodiment of the present invention.

FIG. 8 illustrates a device 170 configured to laminate a protective overlay to a card substrate in accordance with an embodiment of the present invention. Controllers, electrical connections, sensors, and other conventional components are not shown to simplify the discussion of device 170. Device 170 generally includes a supply 172 of protective film 110 (FIG. 2) and a laminating section 174. In accordance with one embodiment of the invention, supply 172 contains a plurality of individual sheets 176 of protective film 110. A sheet feed mechanism 178 includes a plurality of feed and drive rollers 180 that are configured to transport individual sheets 176 from supply 172 to laminating section 174. Device 170 can also include a card supply 182 that is configured to contain a plurality of card members 144. Individual card members 144 contained in card supply 182 can be fed therefrom to laminating section 174 by a card feed mechanism 184 that includes a plurality of guide and feed rollers 186. Sheets 176 of protective film 110 are fed to laminating section 174 such that ink-receptive coating 132 faces the surface 160 of card member 144. Accordingly, in the embodiment depicted in FIG. 8, device 170 feeds sheets 176 with ink-receptive coating 132 facing upward while card members 144 are fed with surface 160 facing downward. However, other configurations are possible.

Laminating section 174 receives a card 144 and a sheet 176 with the sheet 176 preferably covering the entire surface 160 of card member 144. Laminating section 174 includes a heated roller 188 and a backup roller 190. Card member 144 and the adjoining sheet 176 are fed between heated roller 188 and backup roller 190. Heated roller 188 applies heat to sheet 176 while card member 144 and sheet 176 are pinched between heated roller 188 and backup roller 190 to laminate sheets 176 to surface 140 of card member 144. This results in the bonding of ink-receptive coating 132 of sheet 176 to surface 160 of card member 144, as discussed above.

Figure 9:
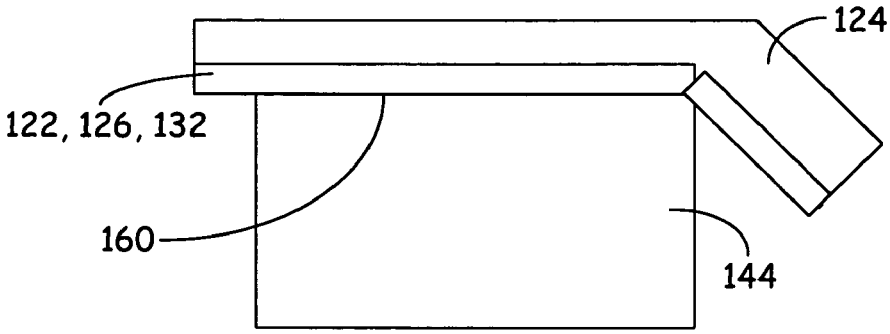
FIGS. 9–10 illustrate the removal of a carrier layer in accordance with an embodiment of the present invention.
Figure 10:
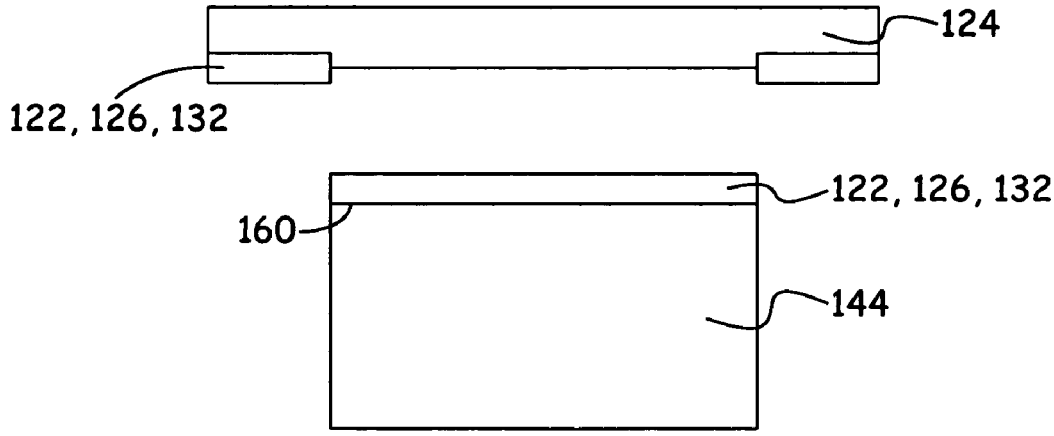

After card package 142 (FIG. 7) exits from the roll laminator 174 (FIG. 8), card package 142 is cooled to ambient temperature. In one embodiment, device 170 can include a separator 192 that is configured to remove carrier layer 124 from the remaining protective film 110. As illustrated in FIG. 9, separator 192 can fold carrier layer 124, transfer film layer 122 and adhesive 126 at the edge of the card and stripping carrier layer 124. Transfer film layer 122, adhesive 126 and ink-receptive coating 132 tend to fracture cleanly at the card to complete formation of an identification card having a protective film 110 as illustrated in FIG. 10.

Figure 11:
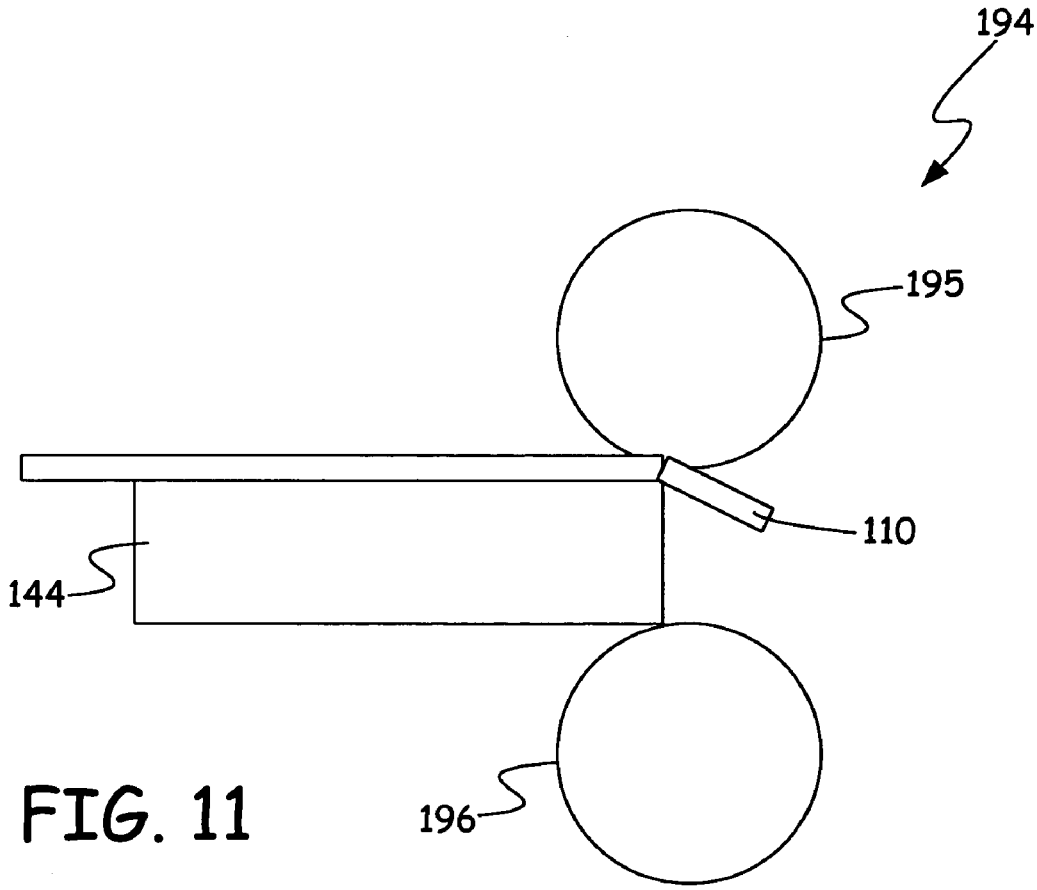
FIG. 11 illustrates the removal of a carrier layer using a soft-hard roller combination in accordance with an embodiment of the present invention.

In another embodiment, separator 192 can be a soft-hard roller combination 194 as illustrated in FIG. 11. Soft-hard roller combination 194 includes deformable soft roller 195 and hard back-up roller 196. Carrier layer 124 is removed and soft-hard roller combination 194 fractures protective film 110 at the edge of card member 144.

Figure 12:
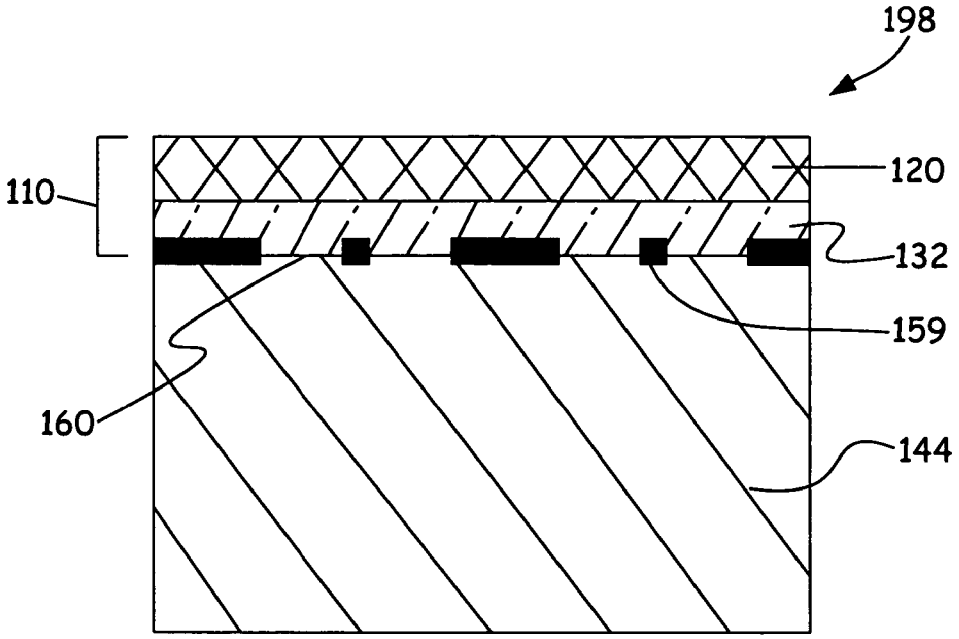
FIG. 12 illustrates a sectional view of an identification card in accordance with an embodiment of the present invention.

FIG. 12 illustrates an identification card 198 having in accordance with an embodiment of the present invention. As illustrated in FIG. 12, the remaining portion of protective overlay 120 and ink-receptive coating 132 will remain on card surface 160 to provide edge-to-edge resilient protection of card member 198. The printed image 159 is sealed within the card construction such that image 159 is protected from wear and abrasion by protective overlay 120 and ink-receptive coating 132. In some embodiments, a thermal adhesive can be coated onto card member 144 prior to bonding ink-receptive coating 132 to card member 144.

Figure 13:
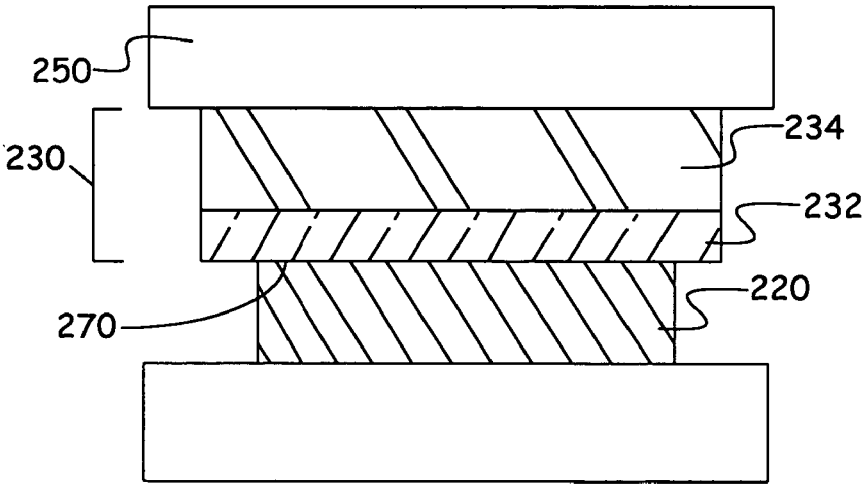
FIG. 13 illustrates a sectional view of a protective film passing through a device for lamination in accordance with an embodiment of the present invention.

In accordance with another embodiment of the present invention, FIG. 13 illustrates a protective overlay 220 and ink-receptive material 230 passing through a device 250 for lamination to form a protective film. Protective overlay 220 is a clear PVC or PVAc film generally 1–5 mils in thickness. In some embodiments, protective overlay 220 can include ultra-violet (UV) absorbing material to provide UV protection for dye-based ink systems. Ink-receptive material 230 includes ink-receptive coating 232 and backing 234. Ink-receptive material 230 is laid over protective overlay 220 with ink-receptive coating 232 facing a surface 270 of protective overlay 220. In some embodiments, thermal adhesives can be coated between ink-receptive coating 232 and protective overlay 220. Both ink-receptive material 230 and protective overlay 220 are placed in device 250. For example, device 250 can be a hot roller or lamination plate, both of which can have or not have a liner. Ink-receptive material 230 is laminated to protective overlay 220 under application of heat (in the range of 290–300 degrees Fahrenheit) and pressure. Sufficient pressure must be applied such that device 250 provides bubble-free lamination. In addition, protective overlay 220 can have a matte surface finish to assist in bubble-free lamination. Ink-receptive material 230 bonds directly to protective overlay 220 to form a protective film having an ink-receptive surface.

To produce continuous rolls of protective overlay 220 with laminated ink-receptive coating 232, protective overlay 220 can be extruded directly onto ink-receptive material 230 in a process called extrusion lamination. The protective overlay 220 and ink-receptive coating 232 produced can be converted into smaller pieces. Alternatively, protective overlay 220 and ink-receptive coating 232 produced can be laminated to a similarly sized card member to be cut into final identification card shapes.

Figure 14:
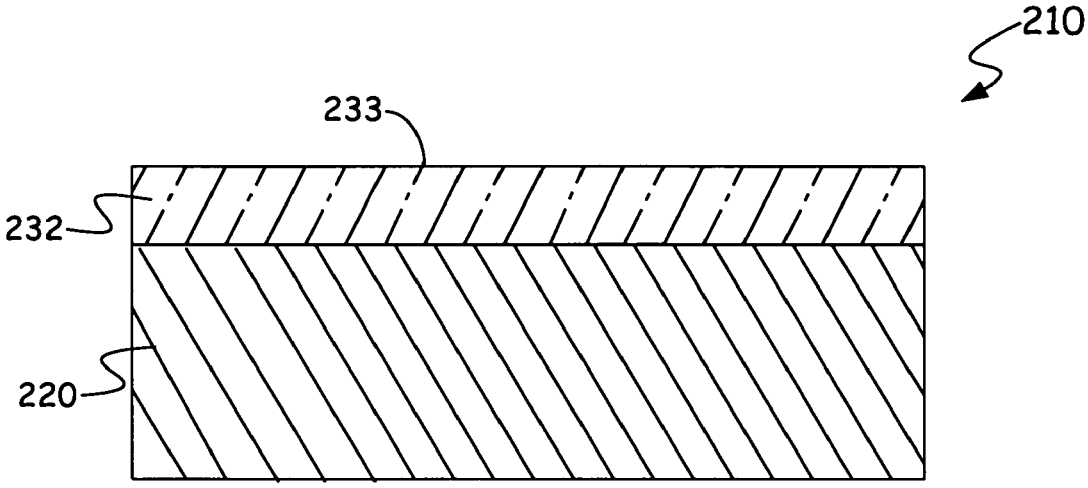
FIG. 14 illustrates a sectional view of a protective film in accordance with an embodiment of the present invention.

After ink-receptive material 230 and protective overlay 220 exit from device 250, ink-receptive material 230 and protective overlay 220 are cooled to ambient temperature. Backing layer 234 is peeled away from ink-receptive coating 232. The resulting protective overlay 220 bonded to ink-receptive coating 232 is illustrated in FIG. 14.

Figure 15:
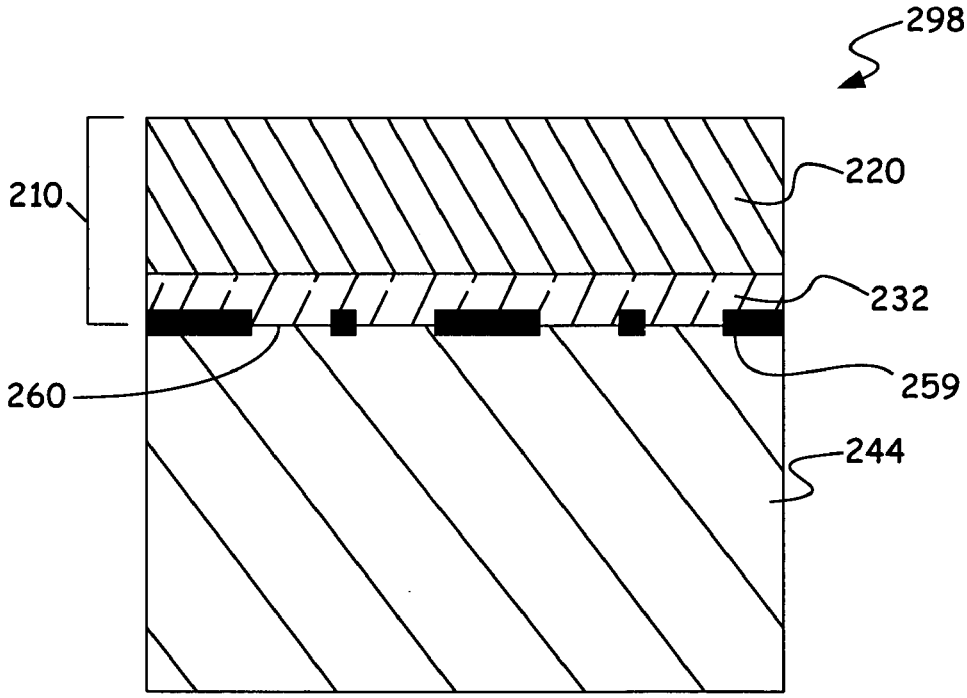
FIG. 15 illustrates a sectional view of an identification card in accordance with an embodiment of the present invention.

In one embodiment, an image can be printed on ink-receptive coating 232 of ink receptive material 230 prior to lamination to protective overlay 220. In another embodiment, an image can be printed on a card member prior to lamination to protective film 210 (FIG. 4). In yet another embodiment, surface 233 of ink-receptive coating 232 is imaged after laminating protective overlay 220 and the removal of backing layer 234. Generally, ink-receptive coating 232 and/or a card member is imaged with a water-based ink jet ink system using a printer. After lamination to a card member, the image will be viewed through protective overlay 220 and ink-receptive coating 232. The image is allowed to dry (1–30 seconds is typically sufficient) before ink-receptive coating 232 and protective overlay 220 are laminated to a card member 244 (FIG. 15). Generally the card member will be a pigmented PVC or PVC/PVAc blend and have a selected thickness such that the final laminated card package is approximately 30 mils.

After laminating ink-receptive coating 232 and protective overlay 220 to card member 244, the card package is allowed to cool to ambient temperature. The resulting identification card 298 is illustrated in FIG. 15 in accordance with an embodiment of the present invention.

As illustrated in FIG. 15, protective overlay 220 provides edge-to-edge resilient protection of card member 244. Printed image 259 is sealed within the card construction such that the image is protected from wear and abrasion.

Ink-receptive material 130 and 230, as utilized in various embodiments illustrated in FIGS. 2–3, 5–7 and 12–15, tends to be more electrically conductive than PVC card stock media and/or protective overlays such as protective overlays 120 and 220. Thus, when printing on ink-receptive coating 132 and 232 in the embodiments of the present invention, static charge can build up and cause frequent card jams during the feeding process.

In one embodiment of the present invention, a surface of a card member is treated with an anti-static coating. The treated surface of the card member can either be opposite the surface laminated to an ink-receptive coating, on the same surface as the surface laminated to an ink-receptive coating, or a combination thereof. For example, a suitable anti-static coating is Dimethyl Ditallow Ammonium Chloride. Dimethyl Ditallow Ammonium Chloride is the active ingredient in Static Guard™ distributed by the Consumer Products Division of Alberto-Culver USA, Inc. of Melrose Park, Ill. Dimethyl Ditallow Ammonium Chloride effectively eliminates any static build up. For example, measured static charge is essentially zero after application of Static Guard™.

Figure 16:
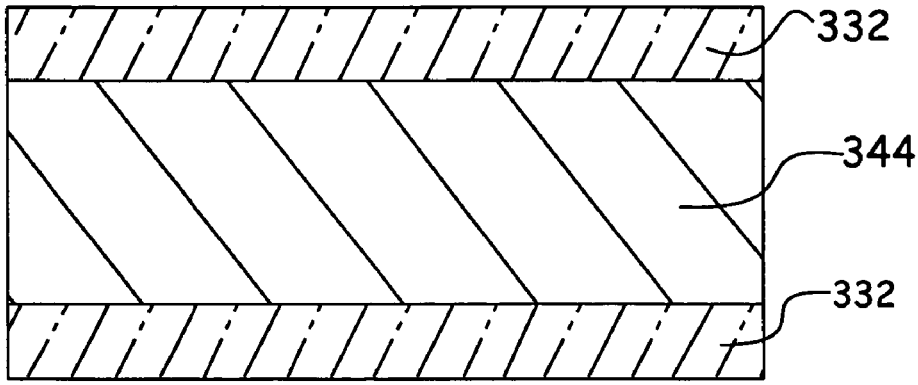
FIG. 16 illustrates a sectional view of a card member in accordance with an embodiment of the present invention.

FIG. 16 illustrates a card member 344 in accordance with an embodiment of the present invention. In FIG. 16, card member 344 includes ink-receptive coating 332 laminated on each side of card member 344 instead of on a single side as previously illustrated. By laminating ink-receptive coating 332 on each side of card member 344 static build up is reduced. For example, static charge, after lamination of ink receptive coating 332 to both sides of a card member, is approximately −0.08 to +0.18 kilovolts (KV).

Figure 17:
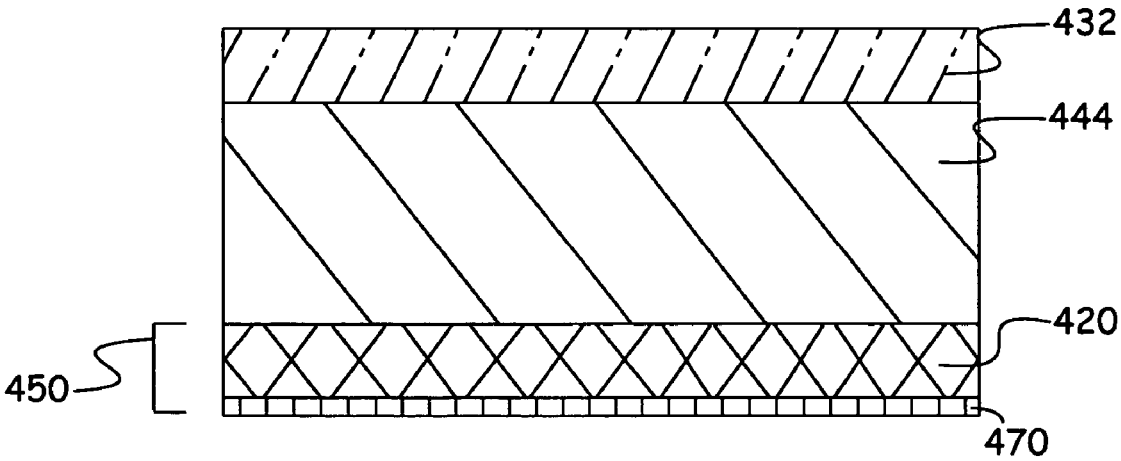
FIG. 17 illustrates a sectional view of a card member in accordance with an embodiment of the present invention.

FIG. 17 illustrates a card member 444 having ink-receptive coating 432 laminated to one surface and an anti-static layer 450 having an overlay film 420 and an anti-static coating 470 laminated to the opposite surface. Overlay film 420 is a clear PVC material. By laminating anti-static layer 450 to card member 44 on an opposite surface from the laminated ink-receptive coating 432, static charge is reduced or eliminated. It is important, however, that anti-static coating 470 or other anti-static coating be compatible with the lamination process and will not leave residues on the lamination plates.

Although the present invention has been described with reference to preferred embodiments, workers skilled in the art will recognize that changes may be made in form and detail without departing from the spirit and scope of the invention.

What is claimed is:

1. A method of forming an identification card comprising:
providing a protective film comprising:
a protective overlay;
an ink-receptive material having an ink-receptive coaxing on a backing layer, the ink-receptive coating bonded to the protective overlay;
removing the backing layer from the ink-receptive coating;
laminating the protective film to a surface of a card member; and
removing a portion of the ink-receptive coating that is not laminated to the surface of the card member.

2. The method of claim 1 and further comprising printing an image to the ink-receptive coating prior to bonding the ink-receptive coating to the protective overlay.

3. The method of claim 1 and further comprising printing an image to the ink-receptive coating prior to laminating the protective film to the surface of the card member.

4. The method of claim 1 and further comprising printing an image to the surface of the card member prior to laminating the protective film to the surface of the card member.

5. The method of claim 1, wherein the providing step comprises providing the ink-receptive coating having an inorganic material and an organic material.

6. The method of claim 5, wherein the inorganic material comprises a boehmite form of alumina hydrate.

7. The method of claim 5, wherein the organic material comprises one of a starch and a polyvinyl alcohol.

8. The method of claim 5, wherein the organic material comprises an organic material that acts as a binder.

9. The method of claim 8, wherein organic material comprises one of a styrene-butadiene copolymer rubber latex, carboxymethyl cellulose, hydroxymethyl cellulose and polyvinyl pyrrolidone.

10. The method of claim 8, wherein the organic material comprises one of dithiocarbamates, thiurams, thiocyanate esters, thiocyanates and hindered amines.

11. The method of claim 1, wherein the ink-receptive coating comprises providing a polymerizable binder.

12. The method of claim 1, wherein the ink-receptive coating comprises magnesium and thiocyanate ions.

13. The method of claim 1, wherein the backing layer comprises one of polyethylene terephthalate (PET), polyester diacetate, polycarbonate resins, fluororesins, and polyvinyl chloride resins.

14. The method of claim 1 and further comprising applying an anti-static coating to the card member.

15. A method of forming a protective film comprising:

providing a protective overlay;

providing an ink-receptive material having an ink-receptive coating removably attached to a surface of a backing layer;

bonding the ink-receptive material to the protective overlay such that the ink-receptive coating is in contact with the protective overlay; and removing the backing layer and a portion of the ink-receptive coating that is not bonded to the protective overlay, the portion of the ink-receptive coating that is not bonded to the protective overlay remains with the backing layer.

16. The method of claim 15, wherein the protective overlay comprises a transfer film layer.

17. The method of claim 16, wherein the protective overlay further comprises a carrier layer, the transfer film layer removably attached to the carrier layer.

18. The method of claim 17, wherein the carrier layer comprises polyester.

19. The method of claim 16, wherein the ink receptive coating is bonded to the transfer film layer with an adhesive.

20. The method of claim 19, wherein the transfer film layer and the adhesive comprises a thickness of 3–6 microns.

21. The method of claim 16, wherein the transfer film layer comprises a security image.

22. The method of claim 21, wherein the security image comprises a hologram.

23. The method of claim 16, wherein the transfer film layer comprises an acrylate polymer such as polymethyl methacrylate.

24. The method of claim 15, wherein the protective overlay comprises one of a clear polyvinyl chloride film and a clear polyvinyl acetate film.

25. The method of claim 24, wherein the protective overlay comprises a thickness of 1–5 mils.

26. The method of claim 15, wherein the ink-receptive coating is imaged with a printer.

27. A method of forming an identification card, the method comprising:

(a) providing a protective overlay;

(b) providing an ink-receptive material having an ink-receptive coating removably attached to a backing layer;

(c) bonding the ink-receptive material to a surface of the protective overlay with the ink-receptive coating in contact with the surface of the protective overlay to thereby form a protective film;

(d) removing the backing layer from the protective film;

(e) laminating the protective film to a surface of a card member, wherein the ink-receptive coating is in contact with the surface of the card member; and (f) removing a portion of the ink-receptive coating that is not laminated to the surface of the card member.

28. The method of claim 27, wherein the protective overlay comprises a transfer film layer.

29. The method of claim 28, wherein the protective overlay comprises a carrier layer removably attached to the transfer film layer.

30. The method of claim 29 and further comprising removing the carrier layer from the protective film.

31. The method of claim 27, wherein the protective overlay comprises one of a clear polyvinyl chloride film and a clear polyvinyl acetate film.

32. The method of claim 27 and further comprising printing an image on a surface of the ink-receptive coating before step (e).

33. The method of claim 32, wherein the printing step comprises printing a reverse image on the surface of the ink-receptive coating.

34. The method of claim 27 and further comprising printing an image on a surface of the ink-receptive coating before step (c).

35. The method of claim 27 and further comprising applying an anti-static coating to a surface of the card member prior to laminating step (e).

36. The method of claim 35, wherein the anti-static coating comprises dimethyl ditallow ammonium chloride.

37. The method of claim 35, wherein the anti-static coating comprises a second ink-receptive coating.

38. The method of claim 35, wherein the anti-static layer comprises an overlay film having an anti-static coating.

39. The method of claim 27 and further comprising printing an image on the surface of the card member prior to step (e).

* * * * *

UNITED STATES PATENT AND TRADEMARK OFFICE

CERTIFICATE OF CORRECTION

PATENT NO. : 6,979,141 B2
DATED : December 27, 2005
INVENTOR(S) : Karl A. Karst et al.

It is certified that error appears in the above-identified patent and that said Letters Patent is hereby corrected as shown below:

Title page,

Item [56], References Cited, U.S. PATENT DOCUMENTS, insert the following:

| | | | |
|---|---|---|---|
| -- 3,193,430 | 7/1965 | Messmer et al. | 156/521X |
| 4,457,964 | 7/1984 | Kaminstein | 428/43 |
| 4,938,830 | 7/1990 | Cannistra | 156/270 |
| 5,079,901 | 1/1992 | Kotsiopoulos | 053/435 |
| 5,290,067 | 3/1994 | Langan | 283/60.1 |
| 5,573,621 | 11/1996 | Boreali | 156/256 |
| 5,637,174 | 6/1997 | Field et al. | 156/256 |
| 5,673,076 | 9/1997 | Nardone et al. | 347/171 |
| 5,783,024 | 7/1998 | Fokert | 156/351 |
| 5,785,224 | 7/1998 | Nowakowski | 225/4 |
| 5,873,606 | 2/1999 | Haas | 283/75 |
| 5,874,145 | 2/1999 | Waller | 428/42.1 |
| 6,136,129 | 10/2000 | Petkovsek | 156/247 |
| 6,159,570 | 12/2000 | Ulrich et al. | 428/40.1 |
| 6,737,139 | 5/2004 | Sidney et al. | 428/43 |
| 6,857,736 | 2/2005 | Onishi et al. | 347/105 |
| 2003/0000637 | 1/2003 | Campion et al. | 428/192 --. |

FOREIGN PATENT DOCUMENTS, insert the following:

| | | |
|---|---|---|
| -- EP | 0 278 517 A2 | 2/1988 |
| JP | 407314882 A | 5/1995 |
| JP | 2870574 | 3/1999 |
| WO | 98/52762 | 11/1998 --; and replace “JP 8-66999 3/1996” with |

-- EP 8-66999 3/1996 --.

UNITED STATES PATENT AND TRADEMARK OFFICE

CERTIFICATE OF CORRECTION

PATENT NO. : 6,979,141 B2
DATED : December 27, 2005
INVENTOR(S) : Karl A. Karst et al.

It is certified that error appears in the above-identified patent and that said Letters Patent is hereby corrected as shown below:

Title page (cont'd),
OTHER PUBLICATIONS, insert the following:
-- International Search Report For International Application No. PCT/US04/18537, filed June 10, 2004, mailing date of April 4, 2005 --.

Signed and Sealed this

Twenty-first Day of March, 2006

JON W. DUDAS
*Director of the United States Patent and Trademark Office*